US006478180B1

(12) United States Patent
Dehn, Sr.

(10) Patent No.: US 6,478,180 B1
(45) Date of Patent: Nov. 12, 2002

(54) INTEGRAL CAP ASSEMBLY FOR LIQUID CONTAINER HAVING A REVERSIBLE POUR SPOUT

(76) Inventor: William F. Dehn, Sr., 638 Arleigh Rd., Severna Park, MD (US) 21146-3406

( * ) Notice: Subject to any disclaimer, the term of this patent is extended or adjusted under 35 U.S.C. 154(b) by 149 days.

(21) Appl. No.: 09/642,651

(22) Filed: Aug. 22, 2000

(51) Int. Cl.[7] ..... B65D 51/18; B65D 55/16; B67D 3/00

(52) U.S. Cl. ..... 220/375; 215/276; 215/306; 220/254.1; 220/259.3; 220/319; 222/539; 222/568

(58) Field of Search ..... 220/375, 254, 220/255, 288, 254.1, 254.8, 259.3, 319; 215/206, 276; 222/464.3, 526, 531, 538, 539, 567, 568

(56) References Cited

U.S. PATENT DOCUMENTS

| | | | | |
|---|---|---|---|---|
| 1,326,853 | A | | 12/1919 | Davis |
| 2,070,783 | A | | 2/1937 | Conner |
| 2,387,011 | A | | 10/1945 | Czerner |
| 2,516,728 | A | | 7/1950 | Smith |
| 2,597,593 | A | | 5/1952 | Neuner |
| 2,630,247 | A | | 3/1953 | Rafferty |
| 3,134,522 | A | | 5/1964 | Shwisha |
| 3,250,434 | A | | 5/1966 | Howlett |
| 3,298,577 | A | | 1/1967 | Chlystun |
| 3,676,076 | A | | 7/1972 | Grady |
| 3,826,409 | A | | 7/1974 | Chilcoate |
| 4,004,709 | A | | 1/1977 | Simkus |
| 4,073,413 | A | | 2/1978 | Tabler et al. |
| 4,082,827 | A | | 4/1978 | Chlystun |
| 4,091,955 | A | | 5/1978 | Sloan, Sr. |
| 4,095,728 | A | | 6/1978 | Chlystun |
| 4,105,135 | A | | 8/1978 | Bradshaw et al. |
| 4,153,172 | A | | 5/1979 | Bialobrzeski |
| 4,252,246 | A | | 2/1981 | Johnson et al. |
| 4,380,302 | A | | 4/1983 | Broad |
| 4,401,241 | A | | 8/1983 | Cruz |
| 4,426,027 | A | | 1/1984 | Maynard, Jr. |
| 4,428,498 | A | | 1/1984 | Obey |
| 4,458,824 | A | | 7/1984 | Baker et al. |
| 4,466,553 | A | | 8/1984 | Zenger |
| 4,492,324 | A | | 1/1985 | Weber |
| 4,529,099 | A | | 7/1985 | Zerrer |
| 4,583,668 | A | | 4/1986 | Maynard, Jr. |
| 4,593,690 | A | | 6/1986 | Sheridan et al. |
| 4,600,125 | A | | 7/1986 | Maynard, Jr. |
| 4,602,728 | A | | 7/1986 | Ha |
| 4,640,446 | A | * | 2/1987 | Walker ..... 222/416 |
| 4,650,100 | A | | 3/1987 | Echazabal, Jr. |
| 4,706,719 | A | | 11/1987 | Eversdijk |
| 4,730,747 | A | | 3/1988 | Schiemann |
| 4,773,458 | A | | 9/1988 | Touzani |
| 4,811,865 | A | | 3/1989 | Mueller, Jr. et al. |
| 4,832,238 | A | | 5/1989 | Taylor |
| 4,844,270 | A | | 7/1989 | Coffman |
| 4,854,471 | A | | 8/1989 | Kasugai et al. |
| 4,921,147 | A | | 5/1990 | Poirier |
| 5,000,236 | A | * | 3/1991 | Jemison ..... 220/375 |
| 5,152,416 | A | | 10/1992 | Cassel |
| 5,154,327 | A | * | 10/1992 | Long ..... 220/375 |

(List continued on next page.)

*Primary Examiner*—Stephen P. Garbe
*Assistant Examiner*—Niki M. Eloshway
(74) *Attorney, Agent, or Firm*—Foley & Lardner

(57) ABSTRACT

An integral cap assembly for a portable liquid container that has a reversible spout, includes a cap portion with an opening and a pair of grooves formed at opposite sides of the opening. A closure cap is coupled to a first flexible member, where the cap portion is coupled to a second flexible member. The first and second flexible members are each coupled to a remaining flexible member. The closure cap can be fitted either above the opening or below the opening of the cap portion, to thereby provide an integral cap assembly with no separate parts when the reversible spout is in either the closed, non-pour position, or the open, pour, position.

13 Claims, 5 Drawing Sheets

U.S. PATENT DOCUMENTS 5,184,747 A 2/1993 Nolte
5,415,316 A 5/1995 Pemberton et al.
5,513,768 A * 5/1996 Smith ..... 220/375
5,573,525 A * 11/1996 Watson et al. ..... 220/375
5,657,792 A * 8/1997 Prest ..... 138/89
5,913,441 A 6/1999 Voirol
5,927,594 A * 7/1999 Gianpaolo ..... 229/125.09
5,944,228 A * 8/1999 Gray ..... 220/375
5,975,328 A 11/1999 Hagano et al.
6,003,709 A * 12/1999 Hagano et al. ..... 220/375
6,036,061 A * 3/2000 O'Donnell ..... 220/375
6,068,153 A * 5/2000 Young et al. ..... 220/254.3
6,145,688 A * 11/2000 Smith ..... 220/375

* cited by examiner

INTEGRAL CAP ASSEMBLY FOR LIQUID CONTAINER HAVING A REVERSIBLE POUR SPOUT

BACKGROUND OF THE INVENTION

1. Field of the Invention

The present invention relates to an integral cap assembly for a liquid container that incorporates a reversible pour spout. In particular, the present invention relates to an integral cap assembly for a portable liquid container, such as a gasoline can, that uses a reversible pour spout in which a cap portion has an opening in which the pour spout is fitted therethrough.

2. Description of the Related Art

Portable liquid containers that use reversible pour spouts are very useful and handy. One such type of portable liquid container is a gasoline can.

Gasoline cans are used for a variety of circumstances, such as for providing gasoline for a lawn mover, or for providing gasoline for a car that has run out of gasoline and that is stopped on the side of a road somewhere. The portability feature of gasoline cans is important, since someone has to carry the gasoline can from one place (typically a gasoline station) to another place (e.g., the side of a road). This is especially true if someone is walking back to their car that has run out of gasoline, and that person has to walk back carrying a full can of gasoline.

Another important feature of a gasoline can, or any type of liquid container for that matter, is the manner in which gasoline or other liquid substance is poured out of the can. Obviously, it is important that this be done without spilling any liquid. Certain types of gasoline cans use a reversible spout, where the neck of the spout fits inside the neck of the gasoline can when the gasoline can is in a "closed" mode, and where the neck of the spout fits outside the can, to allow for gasoline to be poured from the can, when the gasoline can is reconfigured in some manner to be placed in an "open" mode. This reconfiguration basically involves removing the gas can cap, which typically has an opening, or hole, in the central portion thereof. A washer-like cap portion, separate from the gas can cap, is sized to fit within the opening of the gas can cap, when the spout is fitted within the neck of the gas can. That way, gasoline is prevented from flowing from the gas can (via the spout) by way of the washer-like cap portion blocking the gasoline from exiting through the neck of the gas can and thereby to the exterior. In that regard, the gas can cap with the opening, and the washer-like cap portion, together act as a block against gasoline from flowing out of the gas can. For other types of liquid containers, a similar arrangement is possible, in order to prevent the liquid within the container from exiting to the exterior.

Once the gas can cap and the washer-like cap portion are removed from the gas can, the spout can be removed from the gas can. The gas can cap is removed by unscrewing it from the gas can neck, where the gas can neck has threads on an exterior surface thereof, for engaging with the threads of the gas can cap. The washer-like cap portion, which is seated on the reversible spout, can then be picked up by the user and placed away from the gas can neck as well, typically at an nearby the gas can where the gas can cap is placed after its removal from the gas can neck.

Referring now to FIG. 8, the reversible spout 410 has a flanged end 465 and a spout portion 475. The flanged end

465 has a top surface 477 and a bottom surface (not seen in FIG. 7, but it is opposite the top surface 477). The flanged end 465 is of a sufficient size (e.g. diameter) so that its top surface 477 rests against the top edge of the gas can neck when the spout portion 475 is fitted within the gas can neck, when configuring the gas can into the closed mode. The bottom surface of the flanged end 465 is the surface on which the washer-like cap portion sits when the gas can is configured in the closed mode.

To reconfigure the gas can from the closed mode to the open or pour mode, the reversible spout 410 is lifted upwards and out of the neck of the gas can, so as to remove the reversible spout 410 from the gas can. The user then flips the reversible spout 410 around so that the bottom surface of the flanged end 465 rests against the top (toroidal) surface of the gas can neck. With the reversible spout 410 in place, the gas can cap is then screwed back onto the gas can neck. This secures the reversible spout in place, to allow for pouring out of gasoline from the gas can. In this "pour" or "open" mode of the gas can, the washer-like cap portion is not utilized, since it is only used when closing the gas can to prevent gasoline from spilling out from the gas can.

After the pouring operation is complete, the user then unscrews the gas can cap from the gas can neck, and flips the reversible spout 410 around so that the spout portion 475 is fitted within the neck of the gas can (with the top surface 477 of the flanged end 465 resting against the top surface of the neck of the gas can). With the reversible spout 410 in place, the washer-like cap portion is placed so as to cover the hole in the middle of the bottom surface of the flanged end 465, and then the gas can cap is screwed in place onto the gas can neck. In this configuration, gasoline is prevented from flowing from the gas can by way of the gas can cap and the washer-like cap portion forming a tight fit, when both the gas can cap is screwed on tightly onto the gas can neck and the washer-like cap portion is properly positioned within the opening of the gas can neck.

The washer-like cap portion is sized to be slightly larger, but typically of a same geometrical shape, as the opening in the gas can cap and the opening in the top and bottom surfaces of the flanged end 465 of the reversible spout 410. Typically, these openings are circular in shape, and so the washer-like cap portion is also circular in shape.

As explained above, a gasoline can, or any liquid container having a reversible spout, is a very useful tool, and is fairly easy to configure into either the closed configuration or the open (or pouring) configuration. However, one problem does exist in that, when a user has removed the gas can cap and the washer-like cap portion, which are both typically plastic, light-weight pieces, from the gas can, the user may forget exactly where he or she had placed the small-sized washer-like cap portion. As such, the user sometimes spends some amount of time searching around for where he or she had placed the washer-like cap portion. The same is true to a lesser extent with respect to the larger-sized gas can cap.

For example, when a user desires to fill up his or her lawn mower with gasoline, the user may have placed the gas can, the washer-like cap portion, and the gas can cap in a grassy area nearby the gas can. However, after the mowing operation, when the user desires to close the gas can and then store it in a garage or the like, the user may have forgotten exactly where he or she had placed the washer-like cap portion and/or the gas can cap, since those pieces are fairly small and get easily lost in the grass. This leads to unwanted time searching for those pieces of the gas can, and can result in the user having to go to a hardware store to purchase replacement parts, if the user is unable to find either or both of those pieces.

SUMMARY OF THE INVENTION

One object of the present invention is to provide a gas can cap that has an integral design such that a washer-like cap portion (or closure cap) and a gas can cap are held together in place.

Another object of the present invention is to provide a gas can cap that has an integral design such that the washer-like cap portion and the gas can cap are held together in place, and where the integral cap portion itself is held in place on the gas can neck.

At least one of the above-mentioned objects can be achieved by an integral cap assembly for a portable liquid container having a reversible spout. The integral cap assembly includes a cap having an opening for allowing the reversible spout to extend therethrough when the reversible spout is positioned to extend from the portable liquid container to allow gas to be poured from the gas can. The integral cap assembly also includes a closure disk capable of being fitted within the opening of the cap for disallowing liquid to exit from the portable liquid container, when the reversible spout is configured to extend into the portable liquid container. The integral cap assembly further includes means for maintaining the cap and the closure disk together as an integral unit, while allowing the closure disk to be either fitted within the opening of the cap or removed from the opening to allow the reversible spout to be placed through the opening.

At least one of the above-mentioned objects may also be achieved by an integral cap assembly for a portable liquid container. The portable liquid container includes a cap portion that is configured to be adhered to a neck of a gas can, the cap portion having an opening therein for allowing a spout to be fitted therethrough. The portable liquid container also includes a first flexible member that is integrally connected to the cap portion. The portable liquid container further includes a second flexible member that has a connecting portion on one end thereof, for connecting with a closure disk. The first and second flexible members allow for the closure disk to be placed in a first position in which the closure disk is fitted into the opening of the cap portion to close the portable liquid container, and a second position in which the closure disk is removed from the opening but where the closure disk remains connected to the second flexible member.

BRIEF DESCRIPTION OF THE DRAWINGS

The invention will become more fully apparent from the following detailed description when read in conjunction with the accompanying drawings with like reference numerals indicating corresponding parts throughout, and wherein.

DETAILED DESCRIPTION OF THE PREFERRED EMBODIMENT

Preferred embodiments of the present invention will be described in detail hereinbelow, with reference to the drawings.

Figure 1:
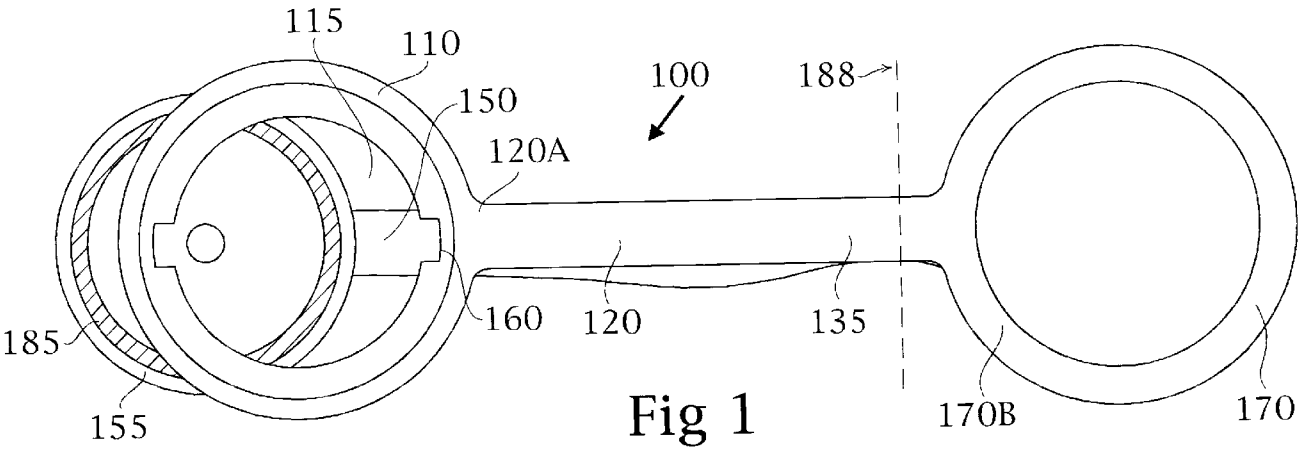
FIG. 1 is a view from below an integral gas can cap assembly according to a first embodiment of the invention.
Figure 2:
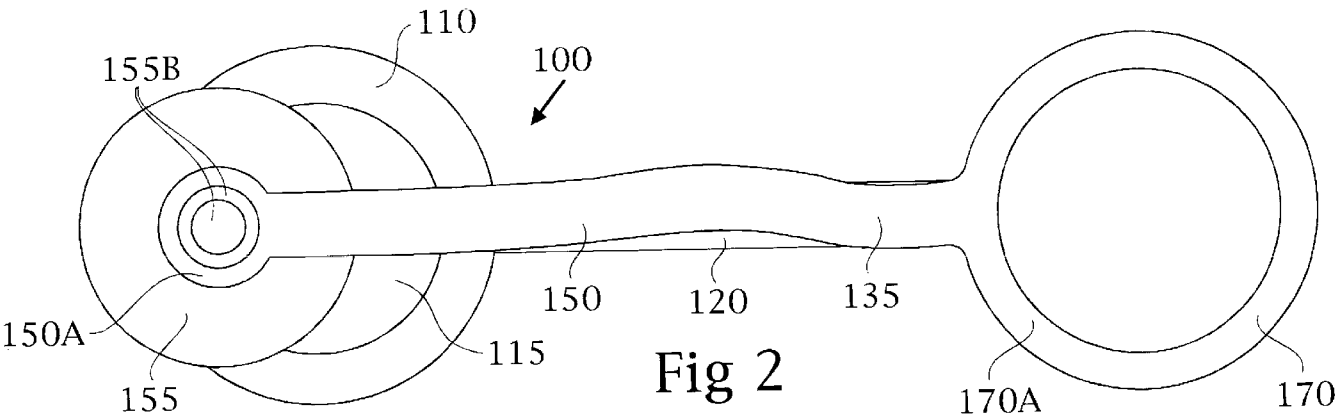
FIG. 2 is a view from above the integral gas can cap assembly according to the first embodiment of the invention.
Figure 3:
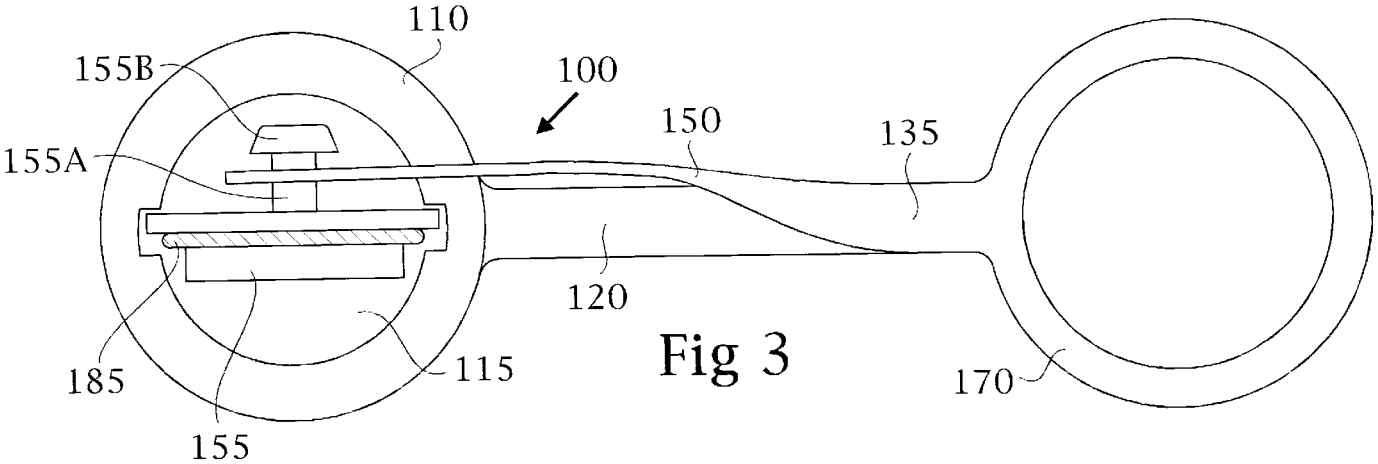
FIG. 3 is a top view of the integral gas can cap assembly according to the first embodiment of the invention, where it is shown with the closure disk portion being turned so that it can be fitted either below or above the gas cap portion, depending upon whether the gas can is being opened or closed.

FIG. 1 shows a view from beneath of an integral gas can cap assembly 100 according to a first embodiment of the invention, and FIG. 2 shows a view from above the integral gas can cap assembly 100. The integral gas can cap assembly 100 includes a gas can cap portion 110, which is attached to a first flexible member 120. Both the gas can cap portion 110 and the first flexible member 120 are preferably made of plastic. The first flexible member 120 is thin enough to allow for flexible movement of the first flexible member 120 with respect to other portions of the integral gas can cap assembly 100 that the first flexible member 120 is integrally coupled to. The combination of the gas can cap portion 10, the first flexible member 120, a second flexible member 150, a remaining flexible member 135, and a loop 170, are preferably a one-piece molded unit, making up a flexible lead-and-cap assembly. For example, the one-piece molded unit may be made by way of a thermoset procedure, or any other type of procedure that will allow for a one-piece construction that provides flexibility for each separate element of the one-piece molded unit.

Referring now to FIGS. 1, 2, 4 and 6, the gas can cap portion 110 includes a top portion with a hole, or opening 115. The hole 115 allows for the reversible spout 410 to be fitted through the hole 115 so as to place the reversible spout 410 in a "pour" position with respect to the gas can, as seen best in FIG. 6. The gas can cap portion 110 also includes side walls, as seen best in FIGS. 4, 6 and 7, which are threaded so that the gas can cap portion 110 can be screwed onto (and unscrewed from) a neck 430 of the gas can, where the neck 430 has similarly-sized threads for engagement with the threads of the sidewalls of the gas can cap portion 110.

Figure 4:
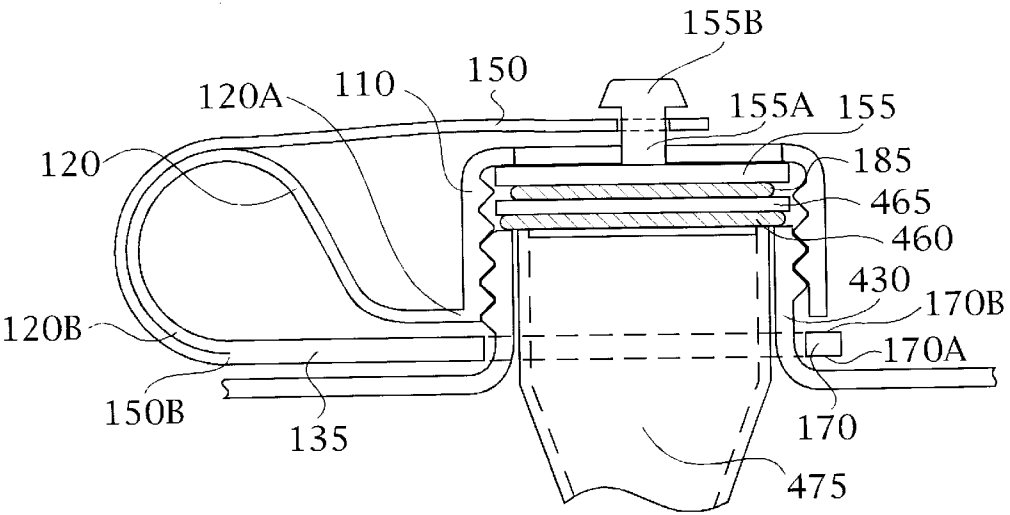
FIG. 4 shows the integral gas can cap assembly according to the first embodiment of the invention in a closed position, to thereby keep any gas in a gasoline can from flowing outside of the gasoline can.
Figure 5A:
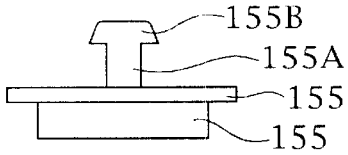
FIG. 5A shows a side view of the closure disk portion according to the first embodiment of the invention.
Figure 5B:
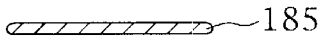
FIG. 5B shows a side view of an O-ring that is configured to fit onto the closure disk portion.
Figure 5C:
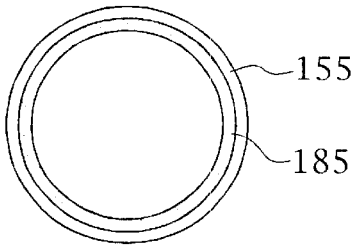
FIG. 5C shows a view from below the closure disk portion, with the O-ring fitted into place.
Figure 5D:
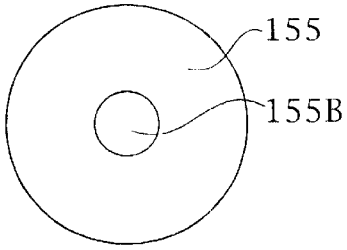
FIG. 5D shows a view from above the closure disk portion.
Figure 5F:
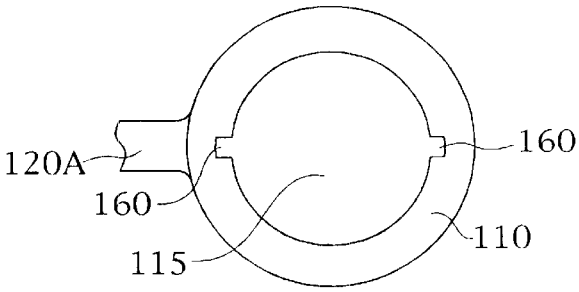
FIG. 5F shows a view from above the gas can cap according to the first embodiment of the invention.
Figure 5E:
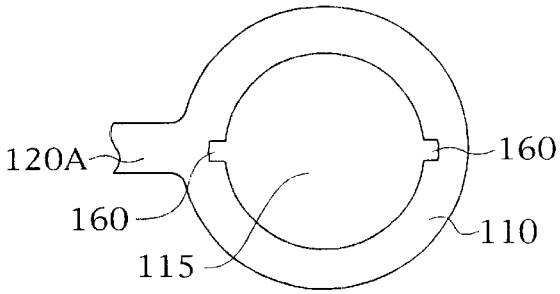
FIG. 5E shows a view from below the gas can cap according to the first embodiment of the invention.
Figure 6:
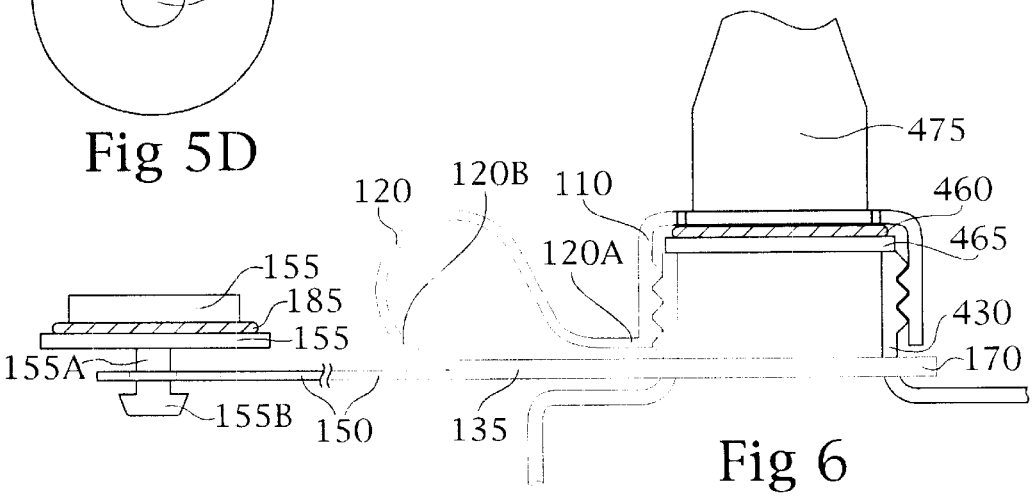
FIG. 6 shows the gas can cap assembly according to the first embodiment of the invention in the open position, to thereby allow gas to flow out of the gasoline can by way of the spout fitted onto the neck of the gasoline can.
Figure 7:
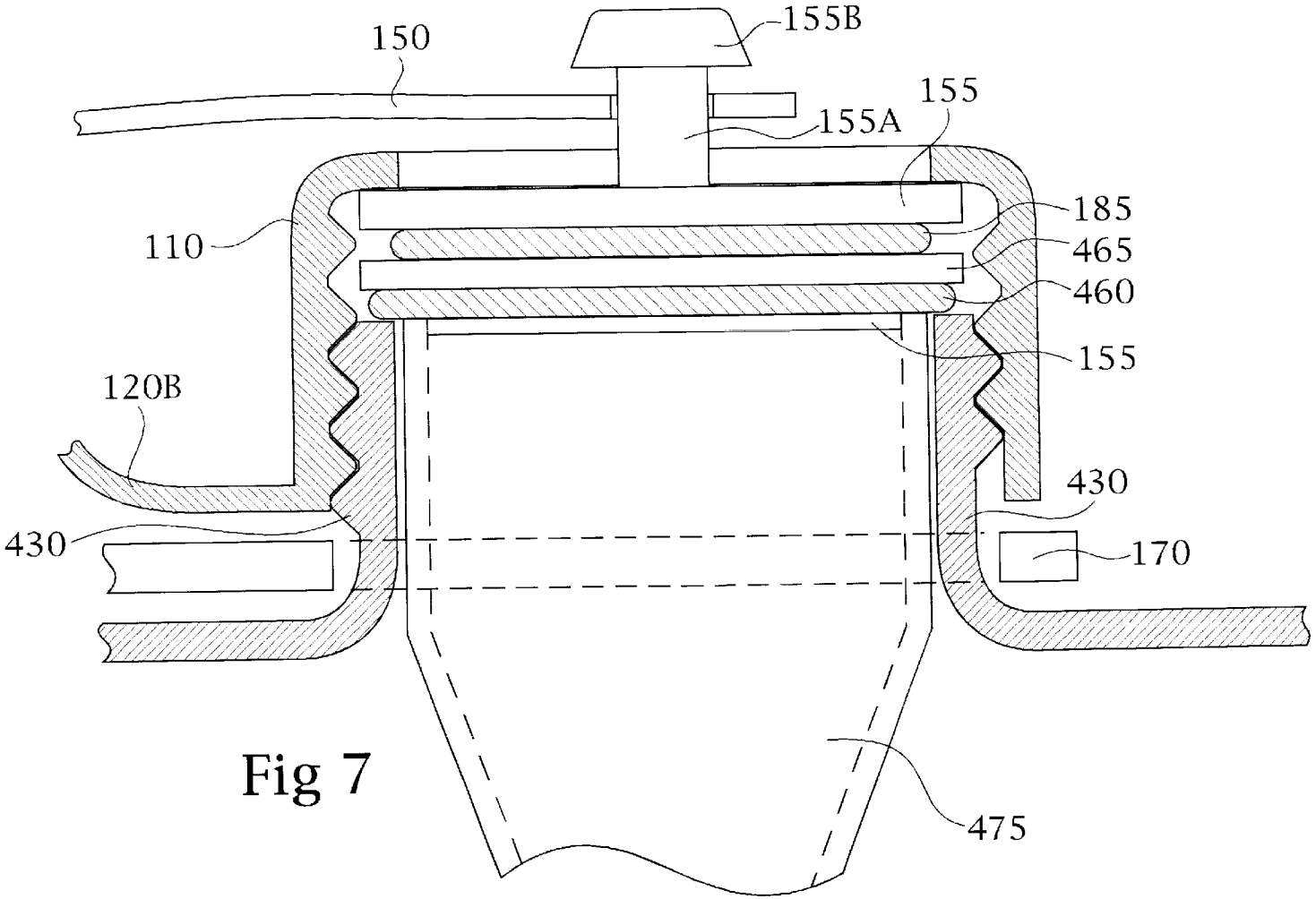
FIG. 7 shows a blow-up view of the gas can cap assembly according to the first embodiment of the invention in the closed position.

Though not shown in FIGS. 4, 6 and 7, the gas can cap portion 110 may have serrations on an outer surface of its sidewalls, so as to allow an operator to easily grip the gas can cap portion 110 so as to either screw it onto the neck 430 of the gas can, or to unscrew it from the neck 430.

As seen best in FIGS. 4, 6 and 7, one end 120A of the first flexible member 120 is integral with a bottom portion of an outer sidewall of the gas can cap portion 110. The other end 120B of the first flexible member is integral with the remaining flexible portion 135.

FIGS. 1, 2, 4 and 6 also show the second flexible member 150, which has one end 150A that has a ring-like region, or hole, for coupling to a closure cap 155. The second flexible member 150 also has another end 150B that is integral (e.g., molded) with the remaining flexible portion 135. The first and second flexible members 120, 150 are preferably sized to be of equal thickness, but different thicknesses of these two members can also be contemplated while remaining within the scope of the invention.

In the first embodiment, the total thickness of the first and second flexible members 120, 150, combined, is preferably equal to the thickness of the remaining flexible portion 135, as seen best in FIG. 4. Again, this is preferable but not required, and different thickness ratios may be contemplated, while remaining within the scope of the invention. All that is required is that each of these members be flexible enough, yet strong enough, to allow for many openings and closings of the gas can, without damage to the integral unit 100.

Referring now to FIGS. 1, 3, 5E and 5F, the gas can cap portion 110 includes two inserts, or grooves 160, formed at opposite positions on the top surface of the gas can cap portion 110. These inserts 160 are used to fit the closure cap 155 either above or below the opening of the gas can cap portion 110, while maintaining the integral structure of the integral gas can cap assembly 100. While just two oppositely-positioned grooves 160 are shown, there may alternatively be a plurality of pairs of oppositely-positioned grooves 160, to allow for ease in repositioning the closure cap 155 through any one pair of the grooves. The grooves 160 preferably have depths such that, when the closure cap 155 is fitted within the opening 115 of the gas can cap portion 110 when the gas can cap portion 110 is screwed onto the gas can neck 430, the closure cap 155 entirely covers both the opening and the grooves 160. However, this need not necessarily be the case, since elements below the gas can cap portion 110, namely the closure cap 155, the cap O-ring 185, the flanged end 465 of the reversible spout 410, the spout O-ring 460, and the top surface of the neck 430 of the gas can, are secured together (by the tightened gas can cap portion 110) so as to maintain a secure liquid seal. Thus, no liquid would exit through the grooves 160 even if there was a small air gap due to the closure cap 155 not entirely blocking the bottom of the grooves 160 (see FIG. 4, for example, which shows the closure cap 155 situated below the grooves 160 of the gas can cap portion 110, and entirely blocking a lower surface of those grooves).

In its steady-state position, the first flexible member 120 is situated at a predetermined position with respect to the second flexible member 150, as seen best in FIGS. 1 and 2. Both the first and second flexible members 120, 150 are integral (e.g., molded) to one end to the remaining flexible member 135. The other end of the remaining flexible member 135 is integral (e.g., molded) with the loop 170. The loop 170 is provided so as to allow the integral gas can cap assembly 100 to be fitted semi-rigidly onto the neck 430 of the gas can, as seen in FIGS. 4 and 6. Preferably, the loop 170 has some flexibility (e.g., it can be bended) and is made of plastic. The loop 170 is preferably sized to be slightly smaller (e.g., 1–100 mm) than the neck 430 of the gas can, with that neck size including the threads extending from the outer sidewalls of the neck 430.

To fit the integral gas can cap assembly 100 onto the gas can, the loop 170 is pressed is placed above the top surface of the neck 430 of the gas can, and then it is pressed downward onto the neck 430, until it rests on the bottom of the neck 430 (and thus the top surface of the gas can main structure). See the position of the loop 170 in FIG. 4, where it has been pressed down so as to be fitted around an outer wall of the neck 430 (below the threads on the outer wall of the neck 430). The loop 170 can be removed from the gas can neck 430 in a similar manner, by pressing upwards on the loop 170 to push it over the threads on the outer wall of the neck 430. The loop 170 allows for the entire gas can cap assembly 100 to be attached to the gas can, while allowing it to be fairly easily removed from the gas can. With this attachment by way of the loop 170, there is a lesser chance that someone will misplace the entire integral gas can cap assembly 100, since it can be always attached to the gas can itself by way of the loop 170.

As explained above, the first and second flexible members 120, 150 have a steady-state configuration in which the first flexible member 120 is positioned at a predetermined location (e.g., "above" in FIG. 6, which shows the integral assembly 100 after the loop 170 has been placed onto the neck 430 of the gas can) with respect to the second flexible member 150. With the loop 170 in place around the outer wall of the neck 430 of the gas can, the user can then start screwing the gas can cap portion 110 onto the neck 430 of the gas can. Before the screwing of the gas can cap portion 110 takes place, or even while it is only partially screwed onto the neck 430 of the gas can, the user repositions the closure cap 155 with respect to the opening 115 of the gas can cap portion 110. This repositioning is shown best in FIG. 3, whereby the user turns the closure cap 155 approximately perpendicular with respect to its resting position (see resting position in FIGS. 1 and 2). The second flexible member 150 flexes due to this turning of the closure cap 155.

The user then fits the closure cap 155 through the grooves 160 of the opening 115 of the gas can cap portion 110, and thereby to the other side of the gas can cap portion 110. Once the closure cap 155 is repositioned, it goes back to its normal position, which is perpendicular to the position shown in FIG. 3, due to the second flexible member 150 flexing back to its steady state position (co-parallel) with respect to the first flexible member 120. The closure cap 155 is now positioned within the gas can cap portion 110.

With the closure cap 155 in place within the gas can cap portion 110, the gas can cap portion 110 can then be screwed tightly onto the neck of the gas can. In the first case described above in which the closure cap 155 was repositioned before screwing of the gas can cap portion 110 onto the neck 430 of the gas can, or in the second case described above in which the closure cap 155 was repositioned after the gas can cap portion 110 was partially screwed onto the neck 430, the tightening of the gas can cap portion 110 will result in a secure, liquid-tight fit, as seen in FIG. 4 and FIG. 6.

As the gas can cap portion 110 is screwed onto the neck 430, the entire integral assembly 100, including the flexible members, rotate with the rotation of the gas can cap portion 110 due to its being screwed onto the neck 430. However, the closure cap 155 does not rotate due to this rotation of the integral assembly 100. This is due to the coupling of the closure cap 155 to the second flexible member 150 that does not impart the rotational movement of the integral assembly 100 onto the closure cap 155. This coupling is made so that, as the gas can cap portion 110 is tightened onto the neck 430 of the gas can, there may be a problem associated with torquing of the second flexible member 150 as the closure cap 155 is also tightened in place (see FIG. 4), and therefore does not want to rotate (in the same amount or at all) with the rotation of the gas can cap portion 150. Note that the entire integral assembly 100 rotates with the tightening of the gas can cap portion 110 onto the neck 430 of the gas can. However, due to the pivotable connection of the closure cap 155 to the second flexible member 150, such torquing of the second flexible member 150 does not occur, and the second flexible member 150 is allowed to rotate with the rotation of the gas can cap portion 110, but where that rotation is not imparted on the closure cap 155.

The coupling of the closure cap 155 to the second flexible member 150 is described as follows. Referring now to FIGS. 5A to 5D, the closure cap 155 is shown with a neck portion 155A and a head portion 155B. The head portion 155A is preferably sized to be slightly smaller than the loop, or hole, on the end 150A of the second flexible member 150. So sized, the loop on the end 150A of the second flexible member 150 can be readily pressed over the head portion 155B and thereby onto the neck portion 155A of the closure cap 155. The neck portion 155A of the closure cap 155 is sized smaller in cross-section than the head portion 155B of the closure cap 155, to allow for relatively frictionless movement of the second flexible member 150 with respect to the closure cap 155. The hole at the end 150A of the second flexible member 150 may be provided with slits (not shown in the figures), to allow for ease in placing the closure cap 155 onto the second flexible member 150. These slits are an optional element for ease in coupling the closure cap 155 to the second flexible member 150.

Figure 8:
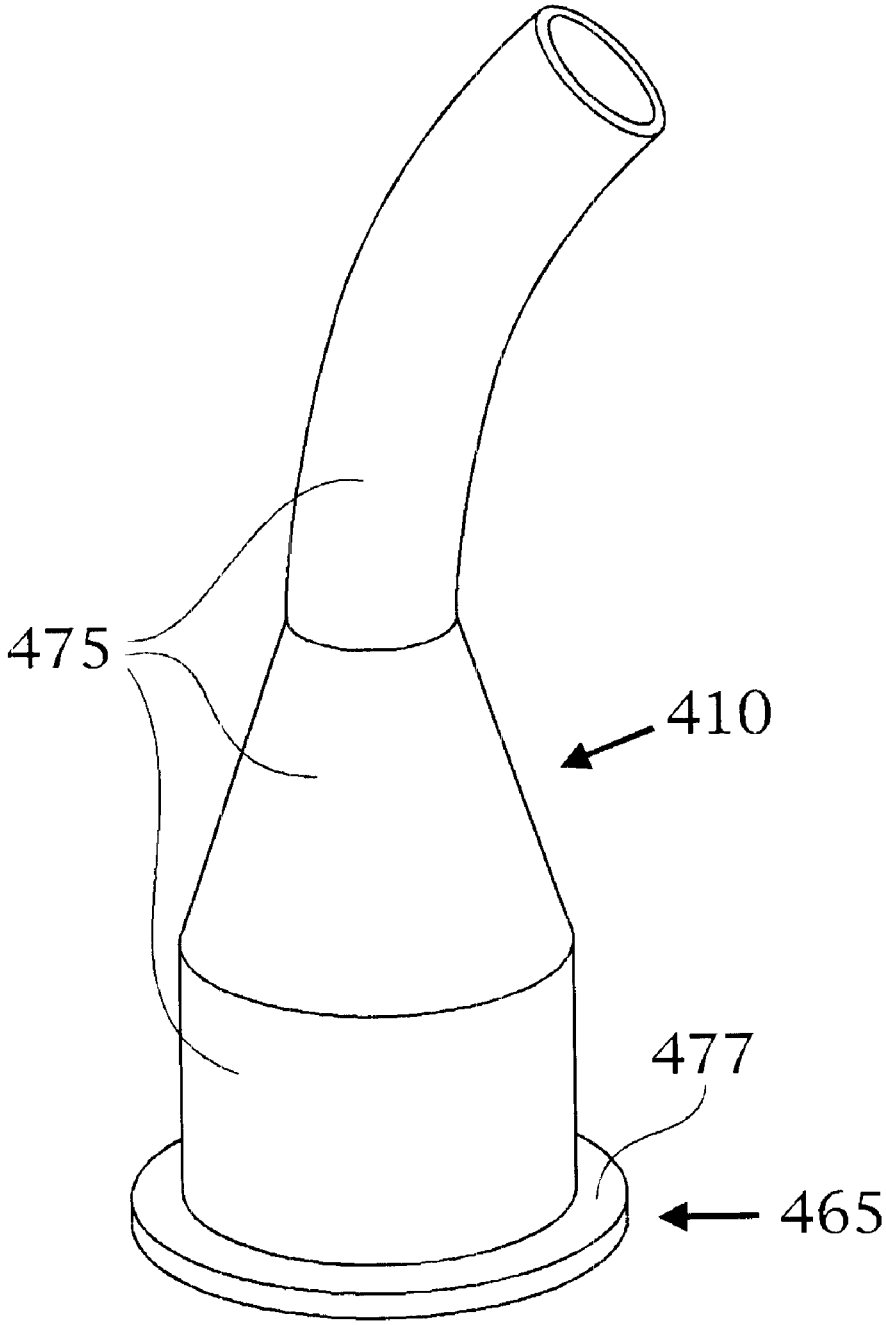
FIG. 8 shows a conventional reversible spout, in a plan view from above the spout.

FIG. 4 also shows the reversible spout 410 in place when the gas can cap portion 110 is in the closed position (screwed onto the neck 430 of the gas can). In the closed position, the reversible spout 410 is placed so that its spout portion 475 is disposed (pointing downwards) within the neck 430 of the gas can. The top of the reversible spout 410, as shown in FIGS. 4 and 8, is the flange portion 465, which is sized so as to rest against the top (toroidal) surface of the neck 430 of the gas can. A spout flange O-ring 460 is also shown, so as to make the closure a liquid-tight closure. That is, the spout flange O-ring 460 (shown as a hatched element in FIG. 4) is situated between the flange portion 465 and the top surface of the neck 430 of the gas can, when the gas can is configured in the closed position. The spout flange O-ring 460 is preferably a rubber component, and can also be a rubberized washer element that is not an O-ring shape.

The closure cap 155 is also shown with an O-ring 185 (see FIGS. 5B and 5C, where it is shown as a hatched element), so as to provide a liquid-tight coupling of the closure cap 155 to the reversible spout 410, when the gas can is configured in the closed position. The cap O-ring 185 is preferably a rubber component. In the closed position, the bottom portion of the closure cap 155 may extend somewhat inside the spout portion 475 of the reversible spout 410, as seen in FIG. 4 and FIG. 6. Due to the particular disposition of the reversible spout 410, the closure cap 155, the cap O-ring 185, and the spout flange O-ring 460, when tightened in place on the neck 430 of the gas can, a fluid block is provided so as to not allow fluid from exiting through the neck 430 of the gas can and thereby to the exterior of the gas can. Note that even if the closure cap 155 is sized so that its top surface does not totally cover the bottom of the grooves 160 on the gas can cap portion 110, this is not a problem, since the liquid seal for the gas can is formed by other components (and other portions of the closure cap 155), as described above.

Now, to reposition the integral gas can cap assembly 100 to allow for pouring out of gasoline from the gas can, via the reversible spout 410, the user first starts to unscrew the gas can cap portion 110 from the neck 430 of the gas can. The closure cap 155 can then be repositioned in a somewhat perpendicular manner with respect to the gas can cap portion 110, such as in the manner shown in FIG. 3, where the closure cap 155 is be fitted through the grooves 160 on the gas can cap 110 and thereby moved back to outside of the gas can cap portion 110. Like the description of the positioning of the closure cap 155 in order to configure the gas can in a closed position, when configuring the gas can to the open or pour position, the closure cap 155 can be repositioned with respect to the gas can cap portion 110 while the gas can cap portion 110 is only partially unscrewed from the neck 430 of the gas can, or after the gas can cap portion 110 has been totally unscrewed from the neck 430. The only requirement is that the gas can cap portion 110 has be unscrewed enough so as to have sufficient space for the closure cap 155 to be manipulated to reposition it to fit through the grooves 160 of the gas can cap portion 110.

With the closure cap 155 positioned outside of the gas can cap portion 110, it can be moved away from the neck 430, such as in a position as shown in FIG. 6. With the gas can cap portion 110 totally unscrewed from the neck 430, it can be moved away from the neck 430 of the gas can (such as to a position just above the closure cap 155 that is shown in FIG. 6 where both the first and second flexible members 120, 150 would be fully extended away from the loop 170), and then the spout portion 475 of the reversible spout 410 can be removed from within the neck 430 of the gas can. The reversible spout 410 is flipped over so that it is now configured in a "pour" position with respect to the gas can, as seen in FIG. 6. In that position, the gas can cap portion 110 is screwed back onto the neck 430 of the gas can, while leaving the closure cap 155 (and the second flexible member 150) distanced away from the gas can neck 430, but still attached to the integral assembly 110 via the second flexible member 150 (as seen in FIG. 6). In this position, the flange portion 465 of the reversible spout 410 rests against the top surface of the gas can cap, with the flange O-ring 460 positioned between the flange portion 460 and the gas can cap portion 110, thereby providing a tight liquid seal so as to allow gasoline to only flow through the inside of the reversible spout 410, and thereby to an exterior of the gas can.

When the user is finished pouring gasoline out of the gas can, the user then unscrews the gas can cap portion 110 from the neck 430 of the gas can, so that the gas can cap portion 110 is moved away from the neck 430 to a position above the closure cap 155 and the second flexible member 150. Then, the user flips the reversible spout 410 around so that its spout portion 475 fits within the neck 430 of the gas can, as seen in FIG. 4. With the reversible spout 410 in place, the user then fits the closure cap 155 through the grooves 160 on the gas can cap portion 110, so that the closure cap 155 is repositioned to within the gas can cap portion 110. The user then screws the gas can cap portion 110 onto the neck 430 of the gas can 100, with the closure cap positioned within the gas can cap portion 10, to ensure a tight covering over the neck 430 of the gas can. As described above, the closure cap 155 may be repositioned to be placed within the gas can cap portion 110, when the gas can cap portion has been partially screwed onto the neck 430 of the gas can.

All during these procedures, the closure cap 155 and the gas can cap portion 110 are not separated from each other, since the gas can cap portion is an element of the integral assembly 100 and since the closure cap 155 is rotatably coupled to the integral assembly 100. This assures that no lost pieces arise due to the reconfiguration of the gas can from the open to the closed position, or vice versa.

While FIGS. 1–7 have been shown with a loop configuration to maintain the assembly onto the gas can, this is an optional feature, in that the assembly may be constructed without such a loop 170, and whereby the integral assembly may be separated from the gas can when the gas can cap portion 10 is unscrewed from the neck 430 of the gas can. Such a configuration may be seen by everything to the left of the dashed line 188 in FIG. 1, which corresponds to elements making up an integral gas can cap assembly according to a second embodiment of the invention. With the second embodiment, while it may be possible to misplace the entire integral gas can cap assembly, since it is a fairly large unit, this is highly unlikely, and much more unlikely than to lose a much-smaller closure disk, as is possible with conventional gas can cap assemblies.

While the present invention has been described with respect to the preferred embodiments, other types of configurations may be possible, while remaining within the spirit and scope of the present invention, as exemplified by the claims. For example, while the first and second embodiments have been described with respect to a gasoline can, the integral cap assembly may be applied to other types of liquid containers that use a reversible spout. Also, while the cap with the opening has been described as having threads for screwing onto a neck portion, other ways of adhering the cap to the neck may be envisioned, such as snap-fitting it in place onto the neck, where the cap is flexible enough to allow it to be snap-fitted onto (and off) of the neck of the liquid container.

Also, while the loop of the second flexible member is shown having small indents for accepting the larger-diameter post 155B of the closure cap 155, the closure cap 155 may be coupled to the second flexible member 150 by other ways. For example, the second flexible member 150 may have an end without a hole, where a pivoting mechanism is provided at that end for coupling to the closure cap. The pivoting mechanism may be a screw-like structure, whereby when the gas can cap portion is threaded onto the neck of the liquid container, the second flexible member is free to rotate with respect to the closure cap via its pivoting connection to the closure cap. This maintains the integrity of the integral cap assembly, so that unwanted torquing of the second flexible member does not exist when the closure cap is tightened in place when the gas can cap portion is tightened in place onto the neck of the gas can.

What is claimed is:

1. An integral cap assembly for a portable liquid container having a reversible spout, comprising:

a cap having an opening for allowing the reversible spout to extend therethrough when the reversible spout is positioned to extend from the portable liquid container to allow liquid to be poured from the portable liquid container, the cap including at least two slots positioned at opposite sides of the opening, wherein the opening has a first length along a plane defined by the at least two slots, and wherein the opening has a second length at all other positions, the second length being less than the first length;

a closure disk capable of being fitted within the opening of the cap for disallowing liquid to exit from the portable liquid container, when the reversible spout is configured to extend into the portable liquid container, wherein the closure disk is configured to be positioned along the plane defined by the at least two slots in order to be moved either: a) from a position outside of the cap to a position inside of the cap when the cap is at least partially coupled to the portable liquid container, or b) from a position inside of the cap to a position outside of the cap when the cap is at least partially coupled to the portable liquid container; and means for maintaining the cap and the closure disk together as a single unit, wherein a diameter of the closure disk is a third length that is greater than the second length but less than the first length.

2. The apparatus according to claim 1, wherein the closure disk is moved from the position outside of the cap to the position inside of the cap, or from the position inside of the cap to the position outside of the cap, by positioning the closure disk to a first disposition perpendicular to a plane defining the opening of the cap, and moving the closure disk through the at least two slots while the first disposition is maintained.

3. The apparatus according to claim 1, further comprising:

means, provided between the closure disk and the reversible spout, for providing an air-tight coupling of the closure disk and the reversible spout when the closure disk is fitted within the opening of the cap, wherein the air-tight coupling keeps any liquid within the portable liquid container from exiting from the portable liquid container when the closure disk is fitted within the opening of the cap.

4. The apparatus according to claim 3, wherein the air-tight coupling means comprises an O-ring.

5. An integral cap assembly for a portable liquid container, comprising:

a cap portion that is configured to be threaded onto a neck of the portable liquid container, the cap portion having an opening therein for allowing a spout to be fitted therethrough;

a toroidal-shaped disk that is configured to be fitted around the neck of the portable liquid container;

a first flexible member that has a first end that is integrally connected to the cap portion, and a second end that is integrally connected to the toroidal-shaped disk;

a second flexible member that has a connecting portion on a first end thereof, for detachably coupling with a closure cap, the second flexible member having a second end that is integrally connected to the cap portion, wherein the first and second flexible members allow for the closure cap to be placed in a first position in which the closure cap is fitted into the opening of the cap portion to close the portable liquid container, and a second position in which the closure cap is removed from the opening but where the closure cap remains connected to the second flexible member, and wherein the respective second ends of the first and second flexible members are integrally connected to each other and to the toroidal-shaped disk.

6. The integral cap assembly according to claim 5, wherein the connecting portion of the second flexible member is a loop, wherein the closure cap includes a post with a head portion at a top of the post, and wherein the head portion of the closure cap is configured to be fitted through the loop so that the closure cap is semi-rigidly coupled to the second flexible member.

7. The integral cap assembly according to claim 6, wherein the head portion is of a larger cross-section than the post.

8. The apparatus according to claim 5, wherein the connecting portion comprises:

non-rotational coupling means for not imparting a rotational force onto the closure cap when the cap portion is rotated on the neck of the portable liquid container.

9. The apparatus according to claim 8, wherein the closure cap comprises:

a circular-shaped cover portion; and a post extending upwards from the circular-shaped cover portion, wherein the non-rotational coupling means comprises:

an opening having a diameter smaller than a diameter of the cover portion of the closure cap; and a plurality of slits disposed around the opening and in contact with the opening, wherein the closure cap is detachably coupled to the second flexible member by inserting the post of the closure cap through the opening and thereby opening up the plurality of slits to thereby fit the post into the opening, to thereby provide a coupling of the closure cap to the second flexible member.

10. A cap unit for a container, comprising:

a toroidal-shaped cap having a circular-shaped opening in a middle portion thereof, the torodial-shaped cap having threads to thereby allow the toroidal-shaped cap to be threaded onto a threaded spout of the container;

a circular-shaped closure cap that is sized to be greater in diameter than the opening of the toroidal-shaped cap and which is adapted to fit onto a top surface of the threaded spout to thereby close the threaded spout, wherein the threaded cap is adapted to be threaded onto the threaded spout with the circular-shaped closure cap previously provided on a top surface of the threaded spout to thereby secure the circular-shaped closure cap onto the threaded spout of the container;

means for integrally coupling the circular-shaped closure cap to the toroidal-shaped cap and for allowing the circular-shaped closure cap to be moved from a first position in which the circular-shaped closure cap is positioned on the top surface of the threaded spout and secured onto the threaded spout by the toroidal-shaped cap being threaded onto the threaded spout, to a second position in which the circular-shaped closure cap is positioned away from the top surface of the threaded spout to thereby provide an opening for the threaded spout;

a toroidal disk that is adapted to fit snugly around an outer circumferential surface of the threaded spout; and a second flexible member for coupling the toroidal disk to the toroidal-shaped cap and for allowing the toroidal-shaped cap to be removed from the threaded spout while the toroidal disk is positioned to fit snugly around the outer circumferential surface of the threaded spout, wherein the integrally coupling means allows the circular-shaped closure cap to be moved away from the toroidal-shaped cap to the second position which is at most a predetermined distance away from the first position, while at a same time maintaining an integral coupling of the circular-shaped closure cap with the toroidal-shaped cap, wherein a liquid pouring device is capable of being held onto the threaded spout of the container by way of the threaded cap being threaded onto the spout portion of the container when the closure cap is not in the first position, wherein the integrally coupling means includes a first flexible member for attaching the toroidal-shaped cap to the circular-shaped closure cap and to allow the toroidal-shaped cap and the circular-shaped closure cap to be placed in contact with each other in a first disposition and to be separated from each other by at least a first distance in a second disposition.

11. The apparatus according to claim 10, wherein the first and second flexible members are configured to hold both the toroidal-shaped cap and the circular-shaped closure cap coupled to each other and to the toroidal disk when the toroidal disk is positioned to fit snugly around the outer circumferential surface of the threaded spout, wherein the toroidal-shaped cap and the toroidal disk are not directly coupled to the threaded spout but are indirectly coupled to the threaded spout by way of the toroidal disk.

12. The apparatus according to claim 10, further comprising:

first and second slots oppositely positioned from each other and disposed on the toroidal-shaped cap adjacent to and abutting the circular-shaped opening of the toroidal-shaped cap, the first and second slots sized so as to allow the circular-shaped closure cap to be moved either from: 1) a position inside the toroidal-shaped cap to a position outside of the toroidal-shaped cap, or 2) a position outside of the toroidal-shaped cap to a position inside of the toroidal-shaped cap.

13. The apparatus according to claim 12, wherein the circular-shaped opening has a first diameter that is less than a diameter of the circular-shaped closure cap at all positions except where the first and second slots are positioned, and wherein the circular-shaped opening has a second diameter that is greater than the diameter of the circular-shaped closure cap at a particular position that is defined by a plane at which the first and second slots are disposed.

* * * * *